US005935612A

United States Patent [19]

Triebes et al.

[11] Patent Number: 5,935,612

[45] Date of Patent: Aug. 10, 1999

[54] PNEUMATIC CHAMBER HAVING GROOVED WALLS FOR PRODUCING UNIFORM NONWOVEN FABRICS

[75] Inventors: Thomas Gregory Triebes, Atlanta; Bryan David Haynes, Alpharetta; Charles John Morell, Roswell; Jeffrey Lawrence McManus, Canton; Rebecca Willey Griffin, Woodstock, all of Ga.

[73] Assignee: Kimberly-Clark Worldwide, Inc., Neenah, Wis.

[21] Appl. No.: 08/671,434

[22] Filed: Jun. 27, 1996

[51] Int. Cl.[6] ..... B29C 47/00

[52] U.S. Cl. ..... 425/72.2; 425/464; 425/7

[58] Field of Search ..... 19/296, 299, 300, 19/301, 302, 304, 305; 425/72.1, 72.2, 82.1, 83.1, 461, 7, 464; 264/168

[56] References Cited

U.S. PATENT DOCUMENTS

| | | | |
|---|---|---|---|
| 3,338,992 | 8/1967 | Kinney | 264/24 |
| 3,341,394 | 9/1967 | Kinney | 161/72 |
| 3,502,763 | 3/1970 | Hartmann | 264/210 |
| 3,542,615 | 11/1970 | Dobo et al. | 156/181 |
| 3,692,618 | 9/1972 | Dorschner et al. | 161/72 |
| 3,802,817 | 4/1974 | Matsuki et al. | 425/66 |
| 3,806,289 | 4/1974 | Schwarz | 425/72 |
| 3,849,241 | 11/1974 | Butin et al. | 161/169 |
| 3,999,250 | 12/1976 | Brown et al. | 19/300 |
| 4,041,203 | 8/1977 | Brock et al. | 428/157 |
| 4,089,086 | 5/1978 | Contractor et al. | 19/305 |
| 4,100,324 | 7/1978 | Anderson et al. | 428/288 |
| 4,340,563 | 7/1982 | Appel et al. | 264/518 |
| 4,780,073 | 10/1988 | Katsumi et al. | 425/72.2 |
| 4,818,464 | 4/1989 | Lau | 264/510 |
| 4,889,476 | 12/1989 | Buehning | 425/72.2 |
| 5,028,375 | 7/1991 | Reifenhauser | 264/518 |
| 5,145,689 | 9/1992 | Allen et al. | 425/72.2 |
| 5,145,727 | 9/1992 | Potts et al. | 428/198 |
| 5,169,706 | 12/1992 | Collier, IV et al. | 428/152 |
| 5,178,931 | 1/1993 | Perkins et al. | 428/198 |
| 5,188,885 | 2/1993 | Timmons et al. | 428/198 |
| 5,445,095 | 8/1995 | Reed et al. | 114/67 |
| 5,695,377 | 12/1997 | Triebes et al. | 442/359 |

FOREIGN PATENT DOCUMENTS 0 646 663 4/1995 European Pat. Off. .

OTHER PUBLICATIONS

Article by Walsh et al., entitled "Optimization and Application of Riblets for Turbulent Drag Reduction," Jan. 9–12, 1984, AIAA 22nd Aerospace Sciences Meeting, Paper No. AIAA–84–0347, pp. 1–10.

Article by Lazos et al., entitled "Turbulent Viscous Drag Reduction with Thin–Element Riblets," Jun. 1, 1987, AIAA Journal, vol. 26, No. 4, pp. 496–498.

Article by Bushnell et al., entitled "Riblets" in book *Viscous Drag Reduction in Boundary Layers,* 1990, vol. 123, pp. 203–261.

*Primary Examiner*—Michael A. Neas
*Attorney, Agent, or Firm*—James B. Robinson

[57] ABSTRACT

There is provided a fabric which has been produced in a pneumatic chamber which has tiny grooves over an effective amount of its fluid contacting surface. Also provided is a method of producing a web having greater uniformity by producing it with pneumatic chambers having surface grooves. Fabrics produced in such a manner have greater uniformity when measured by permeability, basis weight or CD and MD strength properties.

1 Claim, 15 Drawing Sheets

PNEUMATIC CHAMBER HAVING GROOVED WALLS FOR PRODUCING UNIFORM NONWOVEN FABRICS

BACKGROUND OF THE INVENTION

This invention relates to the field of nonwoven fabrics. The manufacture of nonwoven fabrics like meltblown and spunbond fabrics involves the attenuation of polymer streams, generally in a fluid such as air. In spunbond fiber production, for example, fibers are attenuated within a chamber called a drawing unit and deposited onto a moving conveyor belt called a forming wire. In meltblown fiber production fibers the drawing unit usually consists of only a nozzle through which polymer flows and is then attenuated pneumatically before deposition onto the forming wire.

One of the characteristics of certain types of nonwoven fabrics is the uniformity of formation. Non-uniformity can result in varying properties in a given length of nonwoven fabric and cause premature failure of the fabric and/or unsatisfactory appearance of tactile properties. Increasing uniformity should increase the force a nonwoven fabric may withstand prior to failure, i.e. the fabric should be stronger. Fabrics which are, pound for pound, stronger than other fabrics, will allow the products into which they are made to be thinner and lighter weight at the same strength level or simply stronger at the same basis weight.

Though the inventors do not wish to be bound by this belief, some of them believe that one of the impediments to producing a stronger nonwoven fabric is the large scale turbulence produced in the drawing chamber by the large amount of air moving through it along with the fibers. They believe that large scale turbulence disrupts the smooth flow of fibers from the spinneret to the forming wire and so introduces non-uniformities and other areas of weakness within the web. Alternatively, some of the inventors believe that not decreasing but increasing the turbulence in the drawing chamber will result in more shifting of the fibers and so therefore more uniform web production. The exact theory of operation remains undefined, however, the webs produced according to this invention are more uniform than similar webs produced without the use of this invention.

Accordingly, it is an object of this invention to provide a nonwoven fabric which is produced in a novel way which increases web uniformity. The increase in uniformity increases the strength of the nonwoven web.

SUMMARY

The objects of the invention are provided by a nonwoven fabric or web which has been produced in a pneumatic chamber which has tiny grooves over an effective amount of its fluid contacting surface. Such a fabric or web has a uniformity superior to a similar web produced in an ungrooved pneumatic chamber.

A typical pneumatic chamber for the practice of this invention has grooves over an effective amount of its area where the grooves are between about 10 and 6500 microns in depth, 10 and 6500 microns in width, and separated by from 10 to 6500 microns.

The web uniformity is measured by permeability, cross-directional strength or machine-directional strength and, for commercial value, should be about 10 percent greater than a similar web produced without a grooved drawing.

DEFINITIONS

Figure 1:
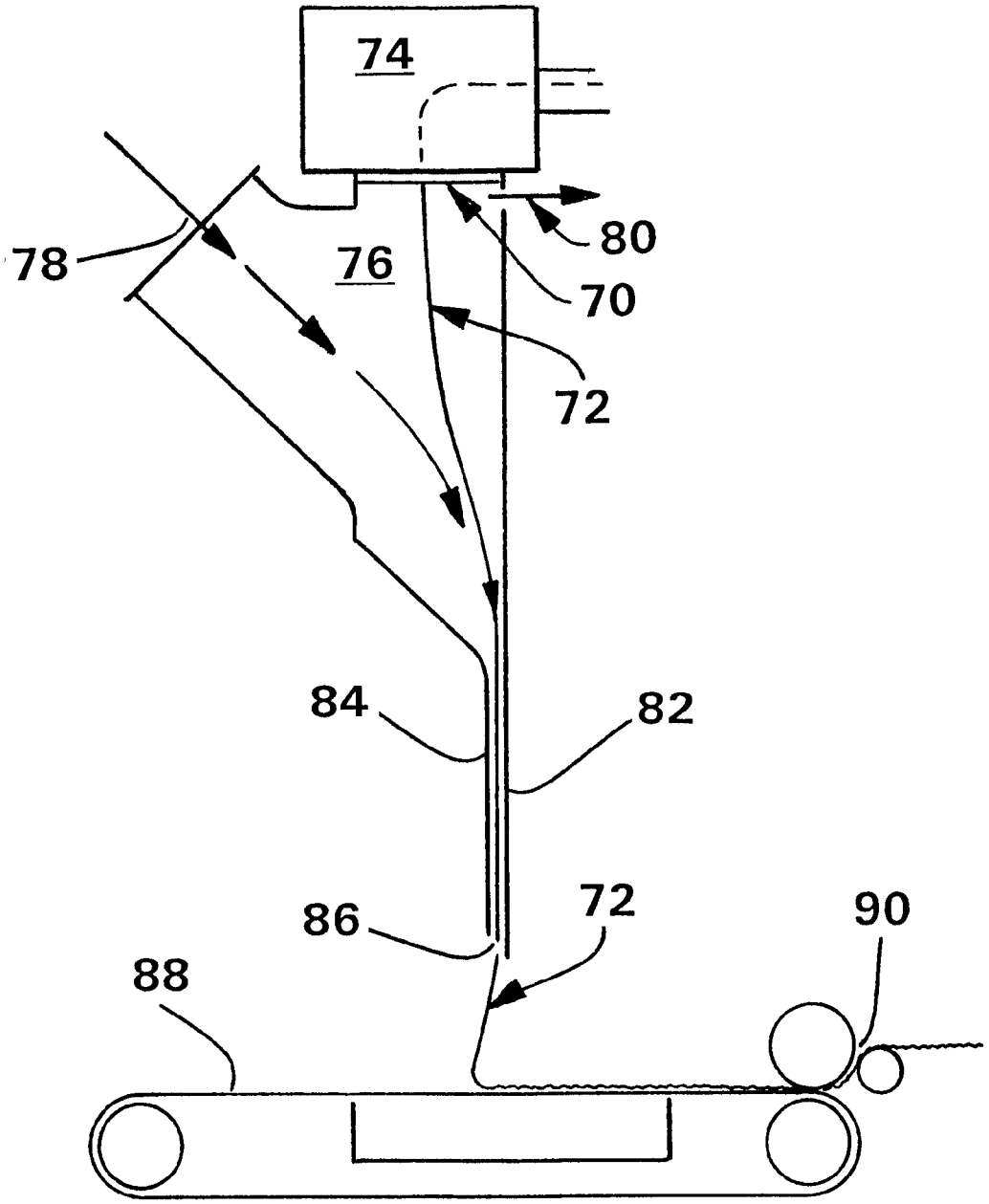
FIG. 1 is a drawing of a typical drawing unit for producing spunbond webs.

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91). As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 40 microns. Another frequently used expression of fiber diameter is denier, which is defined as grams per 9000 meters of a fiber and may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($15^2 \times 0.89 \times 0.00707 = 1.415$). Outside the United States the unit of measurement is more commonly the "tex", which is defined as the grams per kilometer of fiber. Tex may be calculated as denier/9.

As used herein the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin et al. Meltblown fibers are microfibers which may be continuous or discontinuous, are generally smaller than 10 microns in average diameter, and are generally tacky when deposited onto a collecting surface.

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as they are quenched, drawn, usually pneumatically, and deposited on a moving foraminous mat, belt or "forming wire" to form the nonwoven fabric. Examples of this process may be found, for example, in U.S. Pat. No. 4,340,563 to Appel et al., U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,542,615 to Dobo et al. and U.S. Pat. No. 5,028,375 to Reifenhauser. Spunbond fibers are quenched and, therefore, generally not tacky when they are deposited onto a collecting surface. Spunbond fibers are generally continuous and have average diameters (from a sample of at least 10) larger than 7 microns, more particularly, between about 10 and 40 microns.

As used herein "multilayer laminate" means a laminate wherein some of the layers are spunbond and some meltblown such as a spunbond/meltblown/spunbond (SMS) laminate and others as disclosed in U.S. Pat. No. 4,041,203 to Brock et al., U.S. Pat. No. 5,169,706 to Collier, et al, U.S. Pat. No. 5,145,727 to Potts et al., U.S. Pat. No. 5,178,931 to Perkins et al. and U.S. Pat. No. 5,188,885 to Timmons et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such laminated fabrics usually have a basis weight of from about 0.1 to 12 osy (6 to 400 gsm), or more particularly from about 0.75 to about 3 osy (25 to 102 gsm). Multilayer laminates may also have various numbers of meltblown layers or multiple spunbond layers in many different configurations and may include other materials like films (F) or coform materials, e.g. SMMS, SM, SFS, etc.

As used herein, the term "coform" means a process in which at least one meltblown diehead is arranged near a chute through which other materials are added to the web while it is forming. Such other materials may be pulp, superabsorbent particles, cellulose or staple fibers, for example. Coform processes are shown in commonly assigned U.S. Pat. Nos. 4,818,464 to Lau and 4,100,324 to Anderson et al. Webs produced by the coform process are generally referred to as coform materials. An example of a product often made by the coform process is a baby wipe.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein, the term "machine direction" or MD means the length of a fabric in the direction in which it is produced. The term "cross machine direction" or CD means the width of fabric, i.e. a direction generally perpendicular to the MD.

As used herein, the term "garment" means any type of non-medically oriented apparel which may be worn. This includes industrial work wear and coveralls, undergarments, pants, shirts, jackets, gloves, socks, and the like.

As used herein, the term "infection control product" means medically oriented items such as surgical gowns and drapes, face masks, head coverings like bouffant caps, surgical caps and hoods, footwear like shoe coverings, boot covers and slippers, wound dressings, bandages, sterilization wraps, wipers, garments like lab coats, coveralls, aprons and jackets, patient bedding, stretcher and bassinet sheets, and the like.

As used herein, the term "personal care product" means diapers, training pants, absorbent underpants, adult incontinence products, and feminine hygiene products.

As used herein, the term "protective cover" means a cover for vehicles such as cars, trucks, boats, airplanes, motorcycles, bicycles, golf carts, etc., covers for equipment often left outdoors like grills, yard and garden equipment (mowers, roto-tillers, etc.) and lawn furniture, as well as floor coverings, table cloths and picnic area covers.

Test Methods

Frazier Permeability: A measure of the permeability of a fabric or web to air is the Frazier Permeability which is performed according to Federal Test Standard 191A, Method 5450 dated Jul. 20, 1978, and is reported as an average of 3 sample readings. Frazier Permeability measures the air flow rate through a web in cubic feet of air per square foot of web per minute or CFM. Convert CFM to liters per square meter per minute (LMM) by multiplying CFM by 304.8.

Grab Tensile test: The grab tensile test is a measure of breaking strength and elongation or strain of a fabric when subjected to unidirectional stress. This test is known in the art and conforms to the specifications of Method 5100 of the Federal Test Methods Standard 191A. The results are expressed in pounds to break and percent stretch before breakage. Higher numbers indicate a stronger, more stretchable fabric. The term "load" means the maximum load or force, expressed in units of weight, required to break or rupture the specimen in a tensile test. The term "strain" or "total energy" means the total energy under a load versus elongation curve as expressed in weight-length units. The term "elongation" means the increase in length of a specimen during a tensile test. Values for grab tensile strength and grab elongation are obtained using a specified width of fabric, usually 4 inches (102 mm), clamp width and a constant rate of extension. The sample is wider than the clamp to give results representative of effective strength of fibers in the clamped width combined with additional strength contributed by adjacent fibers in the fabric. The specimen is clamped in, for example, an Instron Model TM, available from the Instron Corporation, 2500 Washington St., Canton, Mass. 02021, or a Thwing-Albert Model INTELLECT II available from the Thwing-Albert Instrument Co., 10960 Dutton Rd., Phila., Pa. 19154, which have 3 inch (76 mm) long parallel clamps. This closely simulates fabric stress conditions in actual use.

DETAILED DESCRIPTION

The processes for which this invention may be useful are the meltblowing or spunbonding processes which are nonwoven fabric production methods which are well known in the art. These processes generally use an extruder to supply melted thermoplastic polymer to a spinneret where the polymer is fiberized to yield fibers which may be staple length or longer. The fibers are then drawn, usually pneumatically, and deposited on a moving foraminous mat or belt to form the nonwoven fabric. The fibers produced in the spunbond and meltblown processes are microfibers as defined above.

Nonwoven fabrics are used in the production of garments, infection control products, personal care products and protective covers.

Spunbond nonwoven fabric is produced by a method known in the art and described in a number of the references cited above. Briefly, the spunbond process generally uses a hopper which supplies polymer to a heated extruder. The extruder supplies melted polymer to a spinneret where the polymer is fiberized as it passes through fine openings usually arranged in one or more rows in the spinneret, forming a curtain of filaments. The filaments are usually quenched with air, drawn, usually pneumatically, and deposited on a moving foraminous mat, belt or "forming wire" to form the nonwoven fabric.

The fibers produced in the spunbond process are usually in the range of from about 10 to about 40 microns in diameter, depending on process conditions and the desired end use for the fabrics to be produced from such fibers. For example, increasing the polymer molecular weight or decreasing the processing temperature result in larger diameter fibers. Changes in the quench fluid temperature and pneumatic draw pressure can also affect fiber diameter.

Polymers useful in the spunbond process generally have a process melt temperature of between about 300° F. to about 610° F. (149° C. to 320° C.), more particularly between about 350° F. and 510° F. (175° C. and 265° C.) and a melt flow rate, as defined above, in the range of about 10 to about 150, more particularly between about 10 and 50. Examples of suitable polymers include polypropylenes, polyethylenes and polyamides.

Bicomponent fibers may also be used in the practice of this invention. Bicomponent fibers are commonly polypropylene and polyethylene arranged in a sheath/core, "islands in the sea" or side by side configuration. Biconstituent fibers may also be used in the practice of this invention. Blends of a polypropylene copolymer and polybutylene copolymer in a 90/10 mixture have been found effective. Any other blend would be effective as well provided they may be spun.

This invention pertains particularly to the process used to cool and attenuate the fibers after they are produced by the spinneret. The spunbonding patents cited above, though describing somewhat different processes, have in common that they provide a chamber for pneumatically attenuating the fibers prior to formation of a web. This chamber may be seen in FIG. 1 as item 32 and is sometimes referred to in the cited spunbond patents as a "draw-off tube" (Dorschner), a "sucker unit" (Matsuki), "filament passageway" (Kinney), "yam passageway" (Kinney), "guide passageway" (Hartmann), "venturi nozzle" (Reifenhauser) and "aspirator" (Dobo). The combination of the quench chamber and drawing nozzle is referred to as the drawing unit.

Figure 4:
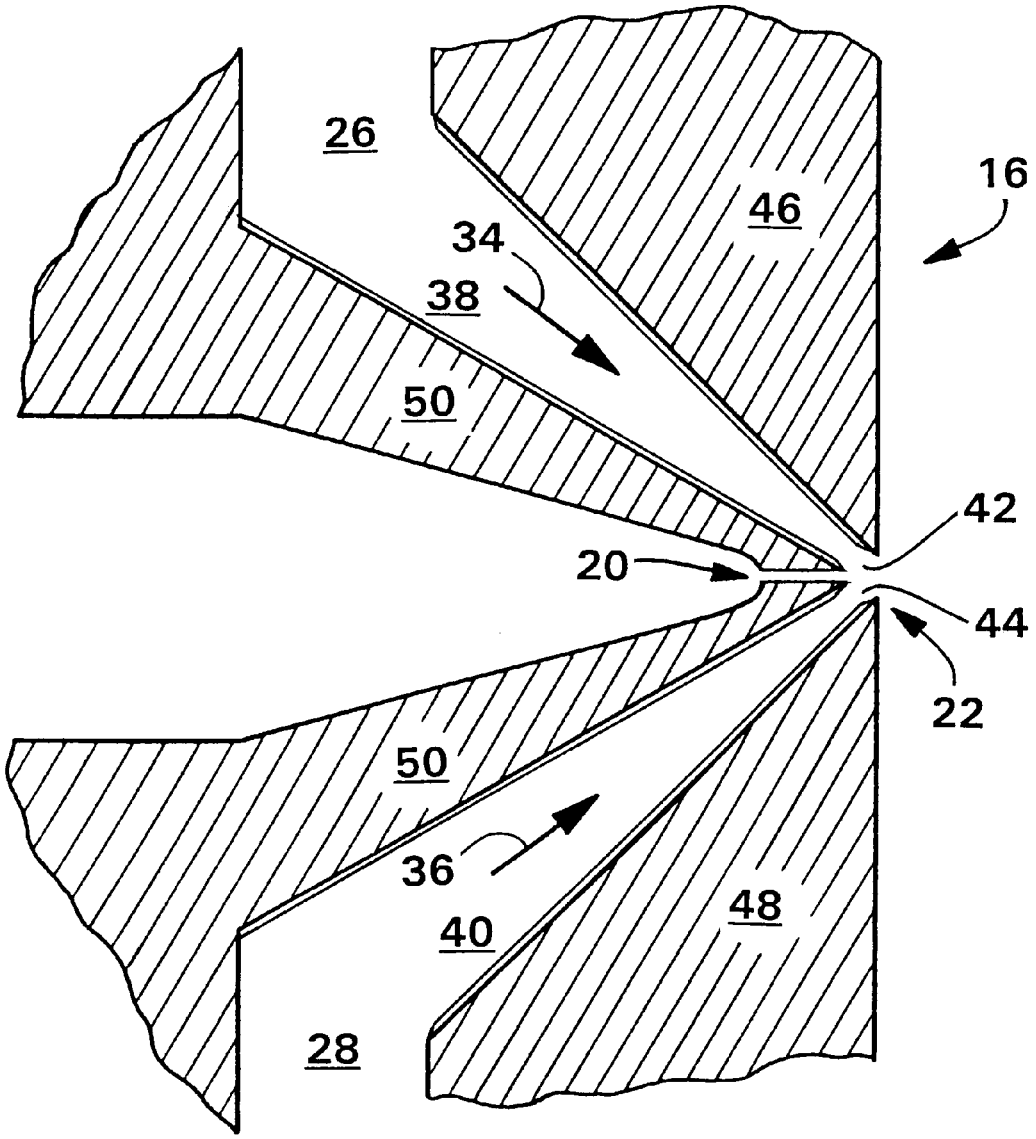
FIG. 4 is a cross-sectional view of the die of FIG. 3 taken along line 4—4.

When used in meltblowing the drawing unit usually includes only a drawing nozzle having chambers and gaps as shown in FIG. 4 as items 38, 40 and 42, 44 and which may be grooved in accordance with this invention. The instant invention is therefore, suitable for use in any fiber producing process which relies on pneumatically drawing fibers. Accordingly, this invention is specifically contemplated to encompass not only spunbond processes but also meltblown processes and others. In order to properly encompass these processes, the term "pneumatic chamber" as used herein means includes at least the spunbonding drawing unit and the meltblowing chambers and gaps.

In FIG. 1, an example of a spunbonding process, the spinneret 70 may be of conventional design and arranged to provide extrusion of filaments 72 from spin box 74 in one or more rows of evenly spaced orifices across the full width of the machine into the quench chamber 76. The size of the quench chamber will normally be only large enough to avoid contact between the filaments and the side and to obtain sufficient filament cooling. The filaments 72 simultaneously begin to cool from contact with the quench fluid which is supplied through inlet 78 in a direction preferably at an angle having the major velocity component in the direction toward the nozzle entrance. The quench fluid may be any of a wide variety of gases as will be apparent to those skilled in the art, but air is preferred for economy. A portion of the quenching fluid is directed through the filaments 72 and withdrawn through exhaust port 80.

Immediately after extrusion through the orifices, acceleration of the strand movement occurs due to tension in each filament generated by the aerodynamic drawing means. The filaments 72 accelerate between the walls 82, 84 and exit through nozzle 86 where they may be gathered onto foraminous mat or belt 88 to form a nonwoven web 90.

In the practice of this invention in spunbond applications, the grooves should extend at least a major portion of the distance from the lower end of the nozzle, to the air inlet and the spinneret, i.e.; wherever fluid may contact the walls of the drawing unit, for maximum effect.

The manufacture of meltblown webs is discussed generally above and in the references and may also be accomplished according to the following general procedure.

Figure 2:
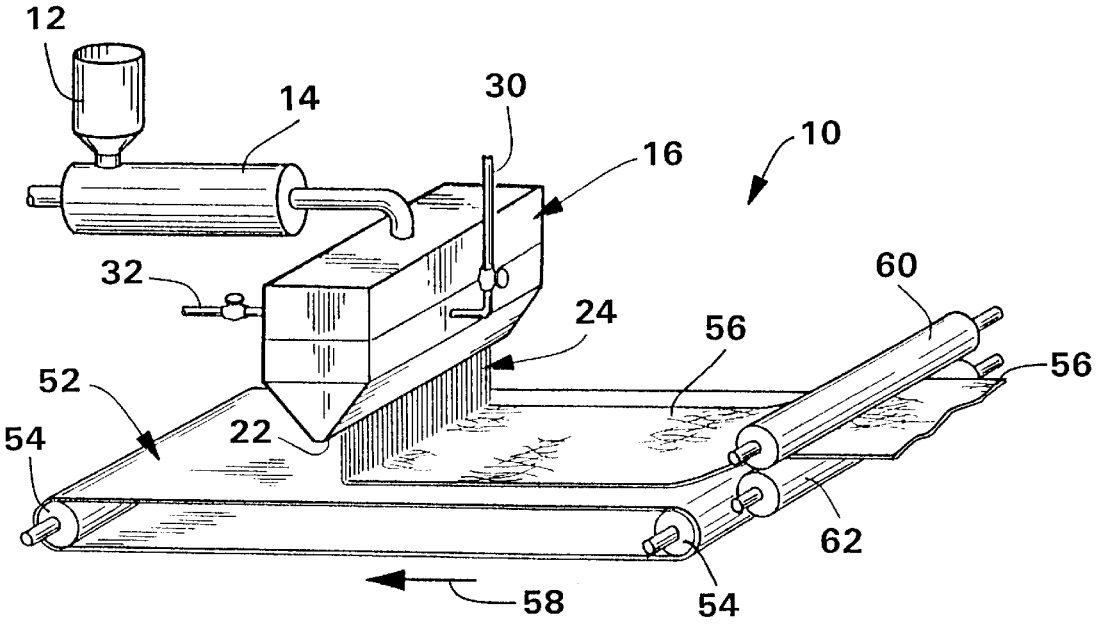
FIG. 2 is a typical apparatus for forming a meltblown nonwoven web.

Turning now to FIG. 2, it can be seen that an apparatus for forming meltblown web is represented by the reference number 10.

In forming the nonwoven web of the present invention, pellets, beads or chips (not shown) of a suitable material are introduced into a hopper 12 of an extruder 14. The extruder 14 has an extrusion screw (not shown) which is driven by a conventional drive motor (not shown). As the material advances through the extruder 14, due to rotation of the extrusion screw by the drive motor, it is progressively heated to a molten state. Heating of the material may be accomplished in a plurality of discrete steps with its temperature being gradually elevated as it advances through discrete heating zones of the extruder 14 toward a meltblowing die 16. The die 16 may yet be another heating zone where the temperature of the thermoplastic resin is maintained at an elevated level for extrusion. The temperature which will be required to heat the material to a molten state will vary somewhat depending upon exactly which material is utilized and can be readily determined by those in the art.

Figure 3:
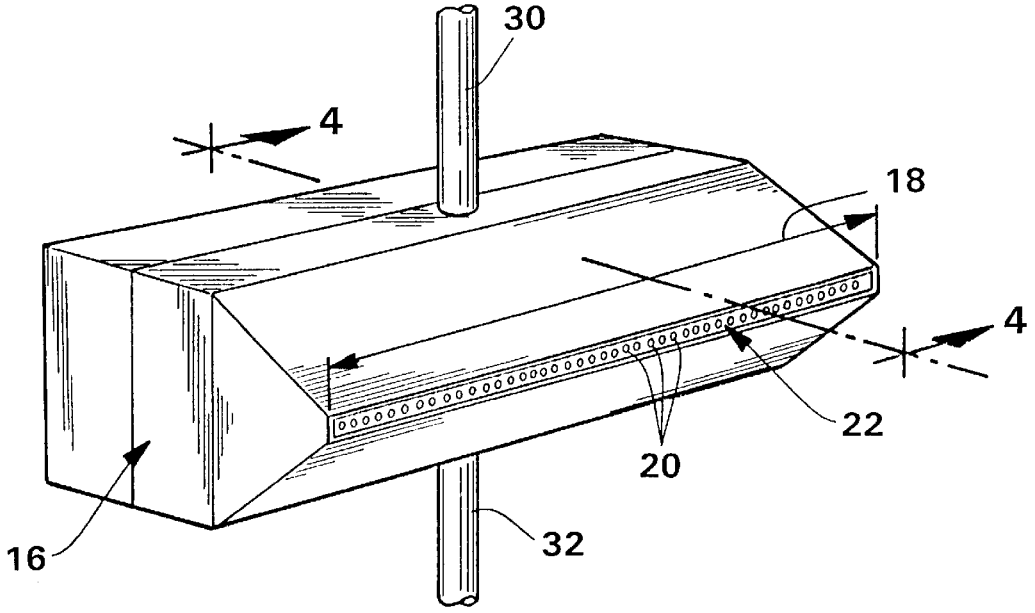
FIG. 3 is a view of the meltblowing die shown as item 16 is FIG. 2.

FIG. 3 illustrates that the lateral extent 18 of the die 16 is provided with a plurality of orifices 20 which are usually circular in cross-section and are linearly arranged along the extent 18 of the tip 22 of the die 16. The orifices 20 of the die 16 may have diameters that range from about 0.01 of an inch to about 0.02 of an inch and a length which may range from about 0.05 inches to about 0.30 inches. For example, the orifices may have a diameter of about 0.0145 inches and a length of about 0.113 inches. From about 5 to about 50 orifices may be provided per inch of the lateral extent 18 of the tip 22 of the die 16 with the die 16 extending from abut 20 inches to about 60 inches or more. FIG. 2 illustrates that the molten material emerges from the orifices 20 of the die 16 as molten strands or threads 24.

FIG. 4, which is a cross-sectional view of the die of FIG. 3 taken along line 4—4, illustrates that the die 16 preferably includes attenuating gas sources 30 and 32 (see FIGS. 2 & 3). The heated, pressurized attenuating gas enters the die 16 at the inlets 26, 28 and follows a path generally designated by arrows 34, 36 through the two chambers 38, 40 and on through the two narrow passageways or gaps 42, 44 so as to contact the extruded threads 24 as they exit the orifices 20 of the die 16. The chambers 38, 40 are designed so that the heated attenuating gas passes through the chambers 38, 40 and exits the gaps 42, 44 to form a stream (not shown) of attenuating gas which exits the die 16 on both sides of the threads 24. It is these chambers 38, 40 and gaps 42,22 which may be grooved in the practice of this invention. The temperature and pressure of the heated stream of attenuating gas can vary widely. For example, the heated attenuating gas can be applied at a temperature of from about 220° to about 315° C. (425–600° F.), more particularly, from about 230° to about 280° C. The heated attenuating gas may generally be applied at a pressure of from about 0.5 pounds per square inch gage (psig) to about 20 psig. More particularly, from about 1 to about 10 psig.

The position of the air plates 46, 48 which, in conjunction with a die portion 50 define the chambers 38, 40 and the gaps 42, 44, may be adjusted relative to the die portion 50 to increase or decrease the width of the attenuating gas passageways 42, 44 so that the volume of attenuating gas passing through the air passageways 42, 44 during a given time period can be varied without varying the velocity of the attenuating gas. Furthermore, the air plates 48, 48 may be adjusted to effect a "recessed" die tip configuration as illustrated in FIG. 4, or a positive die tip 22 stick out configuration wherein the tip of the die portion 50 protrudes beyond the plane formed by the plates 48. Lower attenuating gas velocities and wider air passageway gaps are generally preferred if substantially continuous meltblown fibers or microfibers 24 are to be produced.

The two streams of attenuating gas converge to form a stream of gas which entrains and attenuates the molten threads 24, as they exit the orifices 20, into fibers or, depending on the degree of attenuation, microfibers of a small diameter which is usually less than the diameter of the orifices 20. The gas-borne fibers or microfibers 24 are blown, by the action of the attenuating gas, onto a collecting arrangement which, in the embodiment illustrated in FIG. 2, is a foraminous endless belt 52 conventionally driven by rollers 54. Other foraminous arrangements such as a rotating drum could be used. One or more vacuum boxes (not shown) may be located below the surface of the foraminous belt 52 and between the rollers 54. The fibers or microfibers 24 are collected as a coherent matrix of fibers on the surface of the endless belt 52 which is rotating as indicated by the arrow 58 in FIG. 2. The vacuum boxes assist in retention of the matrix on the surface of the belt 52. Typically, the tip 22 of the die 16 is from about 6 inches to about 14 inches from the surface of the foraminous belt 52 upon which the fibers are collected. The thus collected, entangled fibers or microfibers 24 are coherent and may be removed from the belt 52 as a self-supporting nonwoven web 56.

The inventors have found that providing grooves on the surfaces inside the pneumatic chambers, e.g.; the drawing unit in the spunbond process and the chambers and gaps in the meltblowing process, provides a web of greater uniformity than a similar web produced in a unit without such grooves. By the term "similar web" what is meant is a web which uses essentially the same process conditions and polymers as the inventive web but in which the pneumatic chamber is not grooved. According to *Webster's New Collegiate Dictionary* (1980), "similar" means 1) having characteristics in common; strictly comparable, 2) alike in substance or essentials; corresponding. Using this commonly accepted meaning of the word similar, this term means that all other conditions are essentially the same except for the conditions mentioned. It should be noted that not all conditions could be exactly identical between the grooved and ungrooved units since the presence of the grooves will itself cause process changes, in for example, the pressure drop through the unit.

The effective amount of grooved area in any particular application will depend on the specific conditions in that operating unit. It may be that in certain units only 5 or 10 percent of the fluid contacting area need be covered with grooves to produce the desired increase in uniformity. Its more likely, however, that nearly the entire fluid contacting surface must be grooved to achieve a commercially valuable result.

The grooves in the practice of this invention may be in the direction of flow of the fluid or may also be at an angle to the fluid flow. Its believed that this configuration could result in twisting or coiling of the fibers. Twisting or coiling the fibers should result in a more bulky web and such webs are useful in filtration, for example. Angles in relation to the fluid flow direction of from 0 degrees to plus or minus about 60 degrees are believed to be useful in the practice of this invention. The amount of area of angled grooves could be varied based on the degree of twist desired.

It is also contemplated that the size, spacing, and angle of the grooves may change throughout the pneumatic chamber. In a spunbond drawing unit, for example, the grooves may begin near the polymer nozzle as large and in the direction of fluid flow and change to finer grooves in the lower portion of the drawing unit. The grooves could then be angled near the end of the drawing unit to impart a slight twist to the fibers. It should also be noted that the grooves on the walls of a spunbond drawing unit, for example, need not be angled in the same direction throughout the unit but may change direction from a positive amount up to 60 degrees relative to the direction of fluid flow, to a negative amount up to 60 degrees relative to the direction of fluid flow, defining a total range of 120 degrees.

The inventors also believe that the improved uniformity shown here could also be achieved in other product areas such as in tissue production using a grooved headbox, in staple fiber technology using a grooved fiber chute, in paper production and in coform production using a grooved picker nozzle. Again, the effective amount of area which must be grooved will depend on the specific conditions of the installation, e.g.; fluid conditions (mass flow rate, temperature, pressure, density), geometry of the flow system, etc.

The effect of grooves or ribs in certain applications has been investigated by Walsh and Lindemann in "Optimization and Application of Riblets for Turbulent Drag Reduction", American Institute of Aeronautics and Astronautics (AIAA) Paper 84-0347, January 1984, by Lazos and Wilkinson in "Turbulent Viscous Drag Reduction with Thin-Element Riblets", AIAA Journal vol. 26, no. 4, p. 486 (1988), in U.S. Pat. No. 5,445,095 to Helfrich which is directed to liquid turbulence and additionally uses a drag reducing polymer, and by Walsh in an article entitled "Riblets" in the book *Viscous Drag Reduction in Boundary Layers,* edited by Dennis M. Bushnell and Jerry N. Hefner, published by AIAA (1990), ISBN 0-930403-66-5, and by others. These references are directed to the reduction of drag in a fluid stream in the boundary layer by the use of riblets, ribs or grooves. None of these references teaches or suggests the improvement in the uniformity of formation of a nonwoven web which is the subject of this invention.

Greater web uniformity can be measured indirectly in a number of ways.

Uniformity as used herein means improved permeability, cross-directional strength (peak load or total energy), machine-directional strength (peak load or total energy) or basis weight and "improved" means, in reference to permeability, lower, and in reference to strength, higher. The inventors have produced a number of webs using grooved and ungrooved pneumatic chambers and have tested them for uniformity using these criteria. It should be noted that the improved uniformity phenomenon are more noticeable at lower basis weights than higher basis weights since the increased amount of material in a higher basis weight fabric begins to overshadow the effect of improved formation of the web due to the instant invention. It should further be noted that the improved uniformity may occur at any set of operating conditions, not at one particular set of operating conditions as can be noted in, for example, FIG. 9 where the fabric of this invention produced in a grooved pneumatic chamber has improved permeability at the lower drawing unit pressure but not at the higher drawing unit pressure.

It should still further be noted that the uniformity of a meltblown web is generally measured by the uniformity of the basis weight throughout the web. The reason for this is that meltblown webs are generally too weak to stand up to more rigorous testing like tensile testing. Spunbond webs, therefore, are better candidates for tensile and permeability testing, though they may be tested for basis weight uniformity also.

In FIGS. 5–14, the square symbol represents the measured point for a spunbond web produced with a grooved drawing unit while the diamond symbol is for webs produced without a grooved drawing unit. It should be noted that the data is presented graphically in the Figures instead of in tabular form for ease of viewing, and that each Figure includes data at two points with a line extrapolated between. For the examples that follow, the grooves were machined into a steel drawing unit. The grooves were 0.010 inches (254 microns) in depth, 0.028 inches (711 microns) wide and separated by a distance of 0.015 inches (381 microns). Note that inches can be converted to microns by multiplying inches by 25400.

An alternative method to machining grooves into the pneumatic chamber would be to place on the pneumatic chamber by gluing a commercial tape having the grooves already cut into it. A commercially available tape is produced by the Minnesota Mining and Manufacturing Company (3M) and sold under the trade designation Polyurethane Protective Tape and has grooves which are 50–1700 microns in depth, 50–1700 microns wide and separated by a distance of 50–1700 microns.

Figure 5:
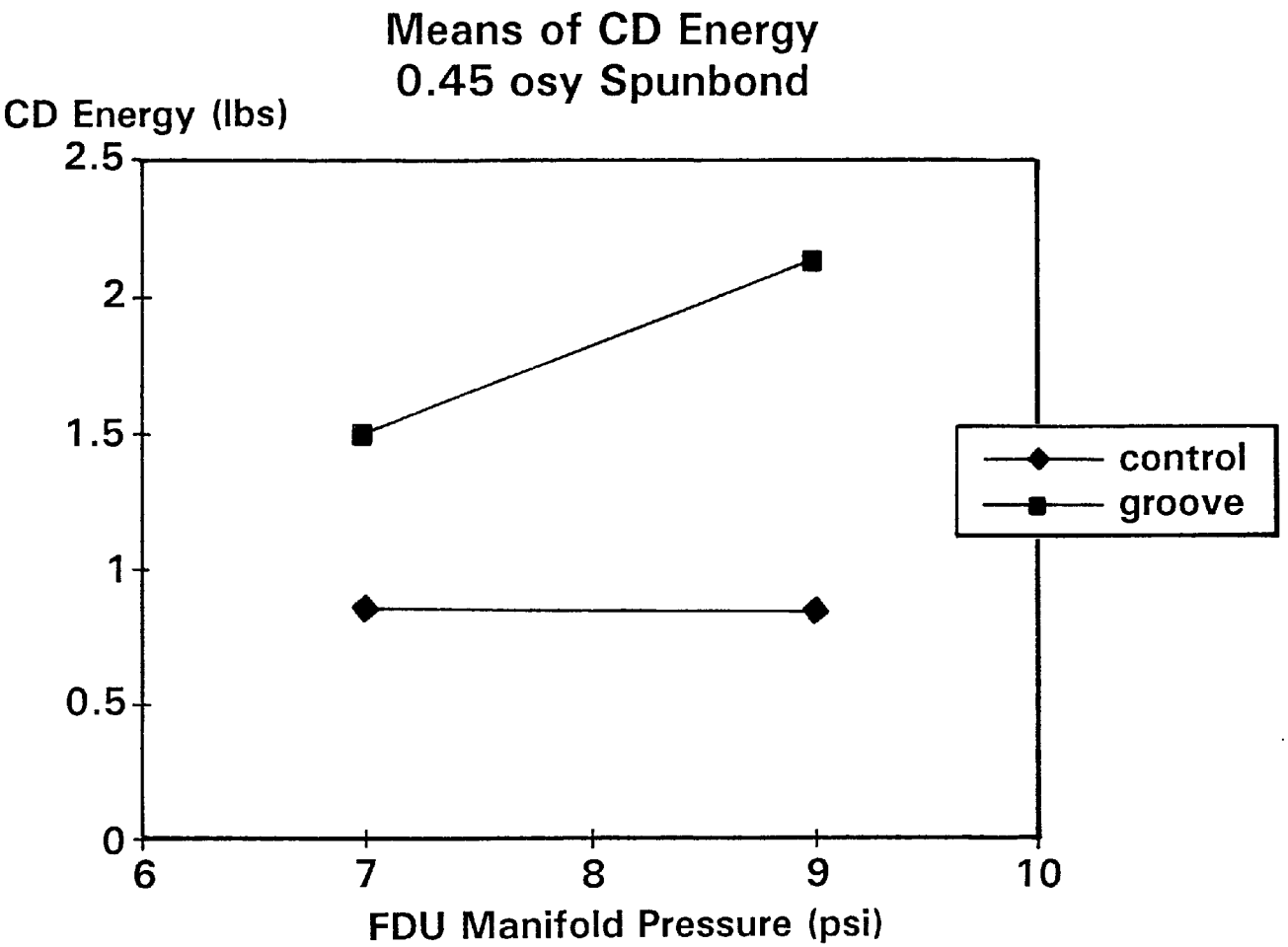
FIGS. 5–14 are graphs showing the relationship between various properties for a web produced with a grooved drawing unit versus an ungrooved unit. In the graphs of FIGS. 5–14, the square symbol represents the measured point for a web produced with a grooved drawing unit while the diamond symbol is for webs produced without a grooved drawing unit.

FIG. 5 is a graph of CD energy in pounds-force on the y-axis and pressure in the quench area in pounds/square inch (psi) on the x-axis for 0.45 osy (15 gsm) basis weight webs. This graph shows that the CD energy was higher using the grooved drawing unit and had a significant increase as the drawing unit pressure was increased.

Figure 6:
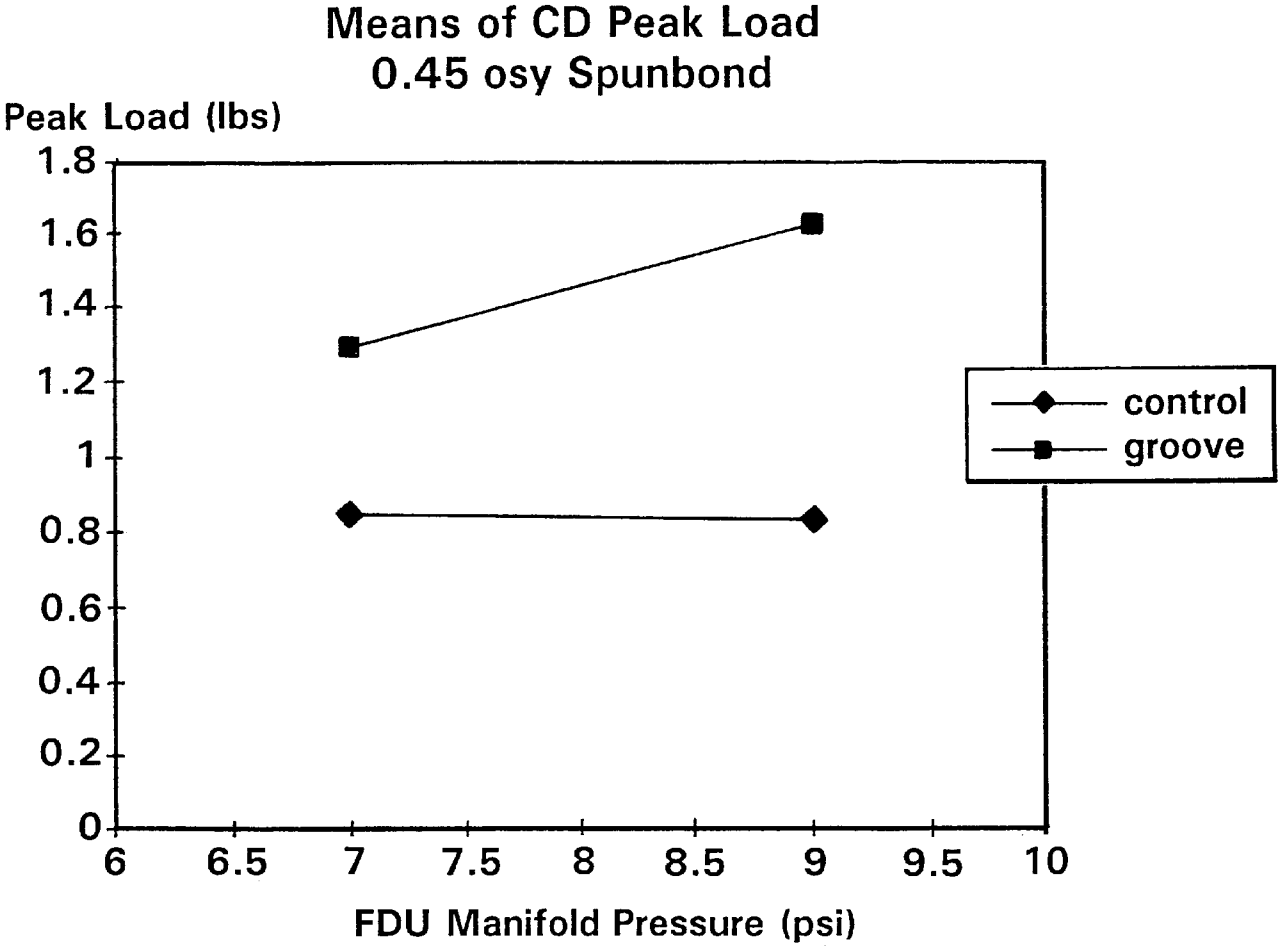

FIG. 6 is a graph of CD peak load in pounds-force on the y-axis and pressure in the quench area in pounds/square inch (psi) on the x-axis for 0.45 osy basis weight webs. This graph shows that the CD peak load was higher using the grooved drawing unit and had a significant increase as the drawing unit pressure was increased.

Figure 7:
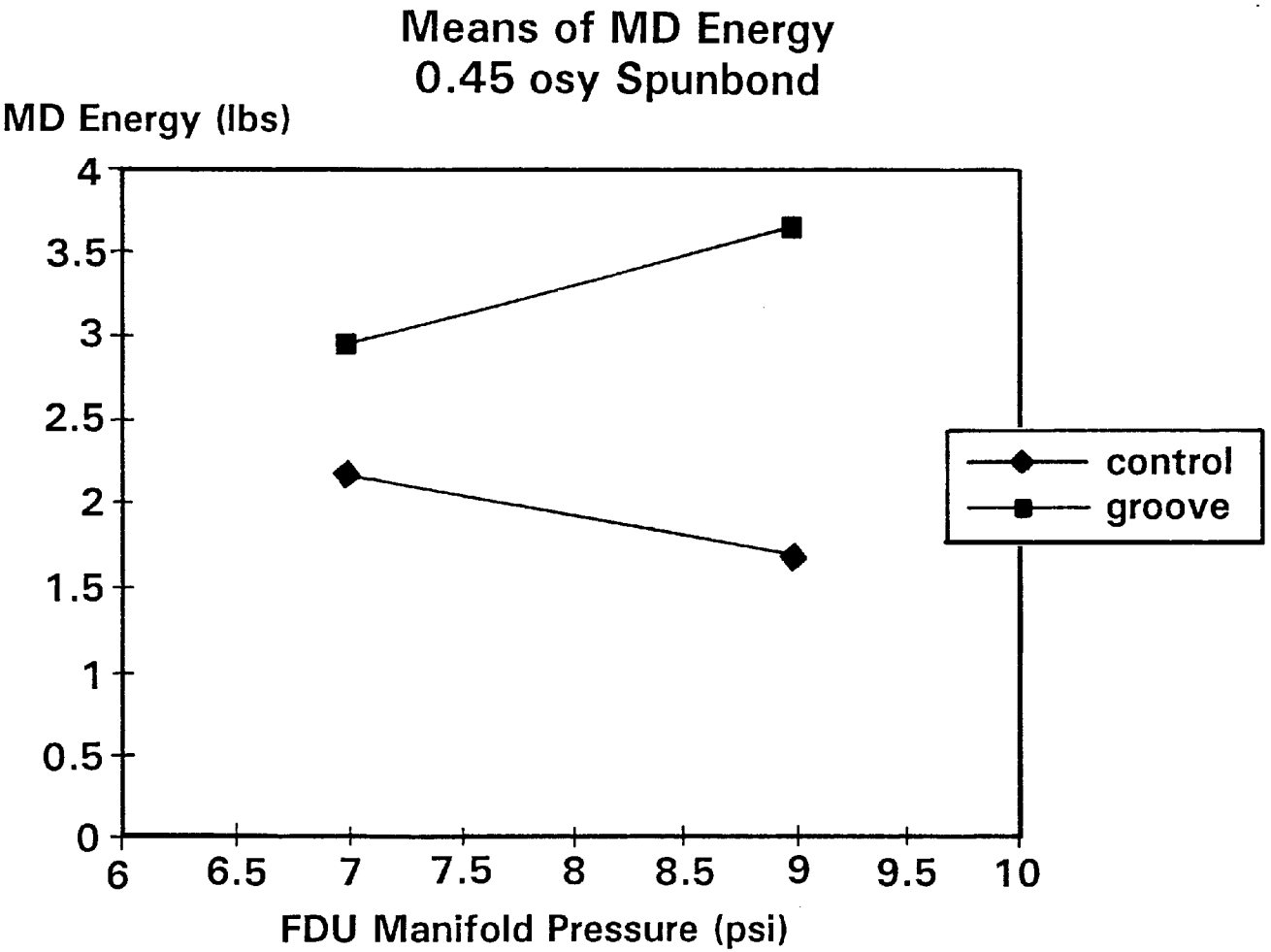

FIG. 7 is a graph of MD energy in pounds-force on the y-axis and pressure in the quench area in pounds/square inch (psi) on the x-axis for 0.45 osy basis weight webs. This graph shows that the MD energy was higher using the grooved drawing unit and had a significant increase as the drawing unit pressure was increased while the web from the ungrooved drawing unit showed a significant decrease with increasing drawing pressure.

Figure 8:
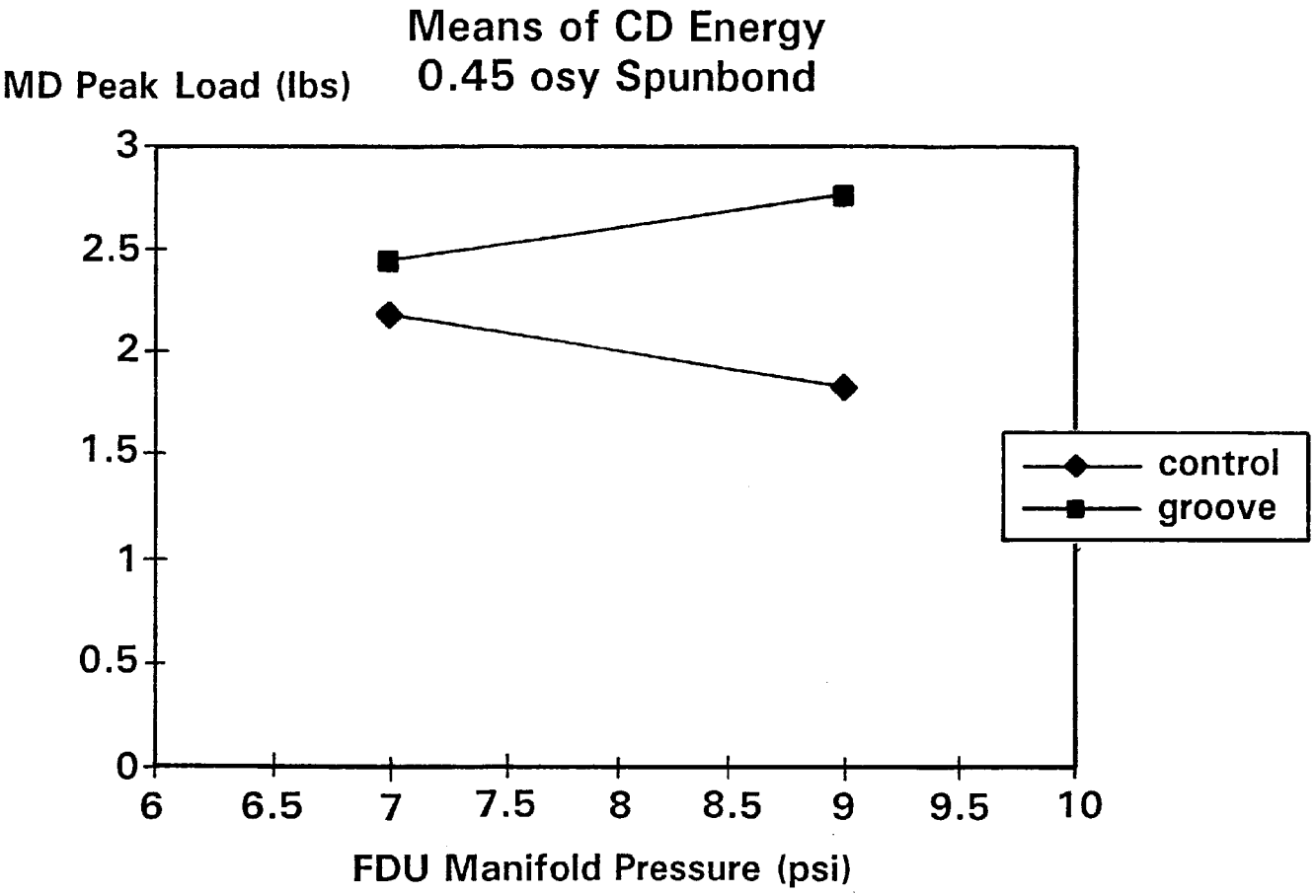

FIG. 8 is a graph of MD peak load in pounds-force on the y-axis and pressure in the quench area in pounds/square inch (psi) on the x-axis for 0.45 osy basis weight webs. This graph shows that the MD peak load was higher using the grooved drawing unit and had a significant increase as the drawing unit pressure was increased, while the web from the ungrooved drawing unit showed a significant decrease with increasing drawing pressure.

Figure 9:
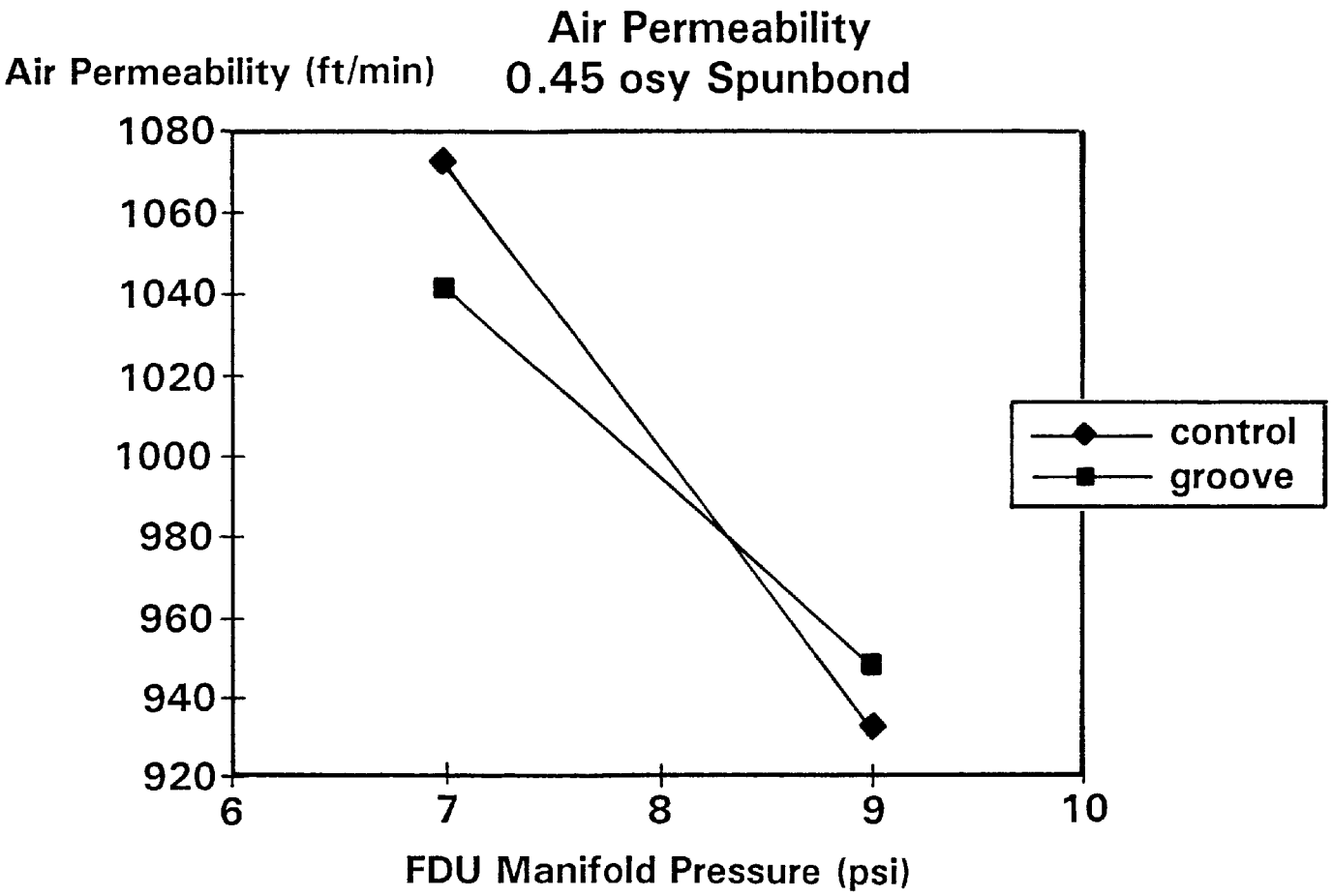

FIG. 9 is a graph of the air permeability of each 0.45 osy web and showed a significant decrease with increasing pressure with the grooved unit starting at a lower permeability but not decreasing as much as the control unit.

Figure 10:
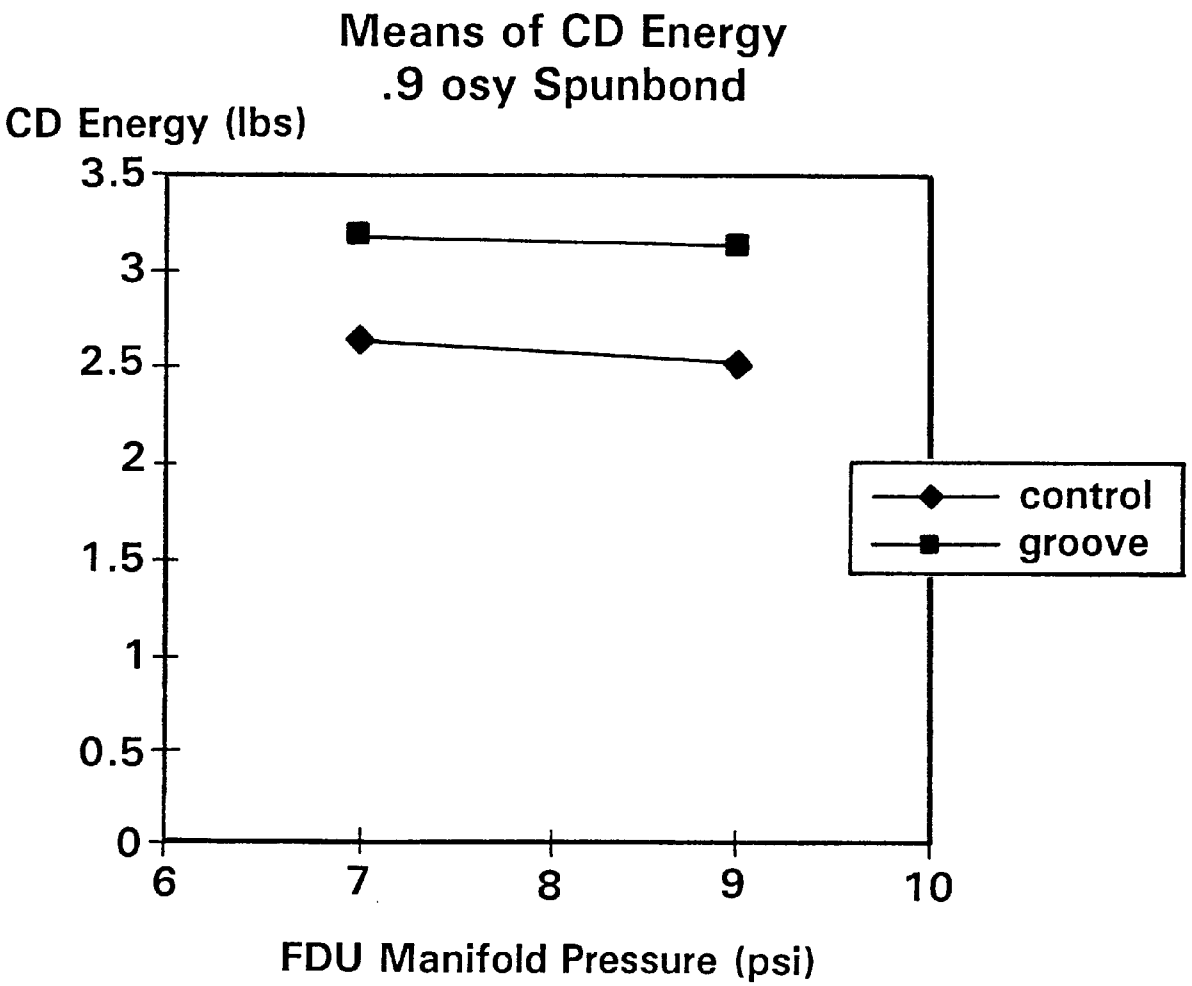

FIG. 10 is a graph of CD energy in pounds-force on the y-axis and pressure in the quench area in pounds/square inch (psi) on the x-axis for 0.9 osy (30.5 gsm) basis weight webs. This graph shows that the CD energy was higher using the grooved drawing unit than using an ungrooved unit.

Figure 11:
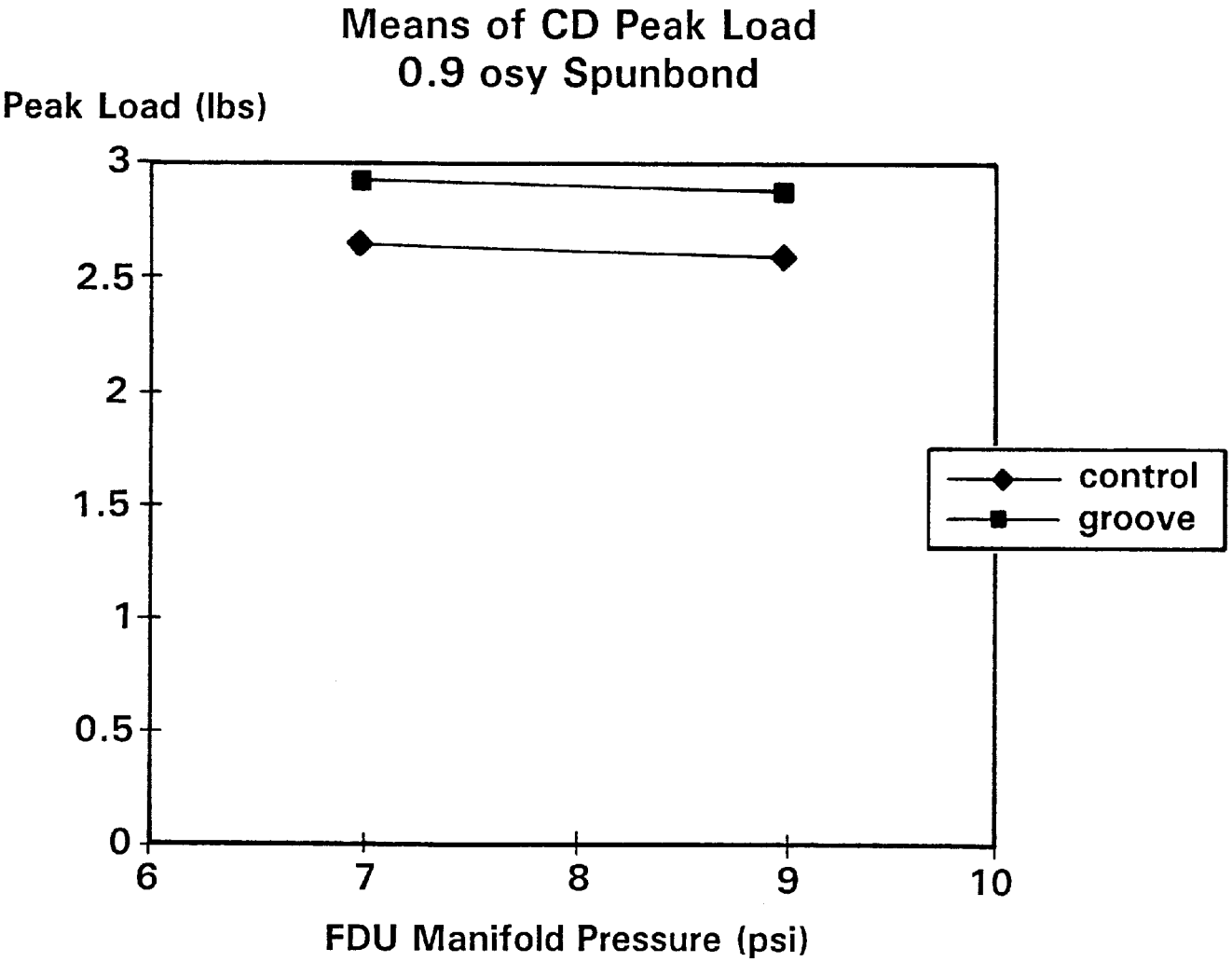

FIG. 11 is a graph of CD peak load in pounds-force on the y-axis and pressure in the quench area in pounds/square inch (psi) on the x-axis for 0.9 osy basis weight webs. This graph shows that the CD peak load was higher using the grooved drawing unit.

Figure 12:
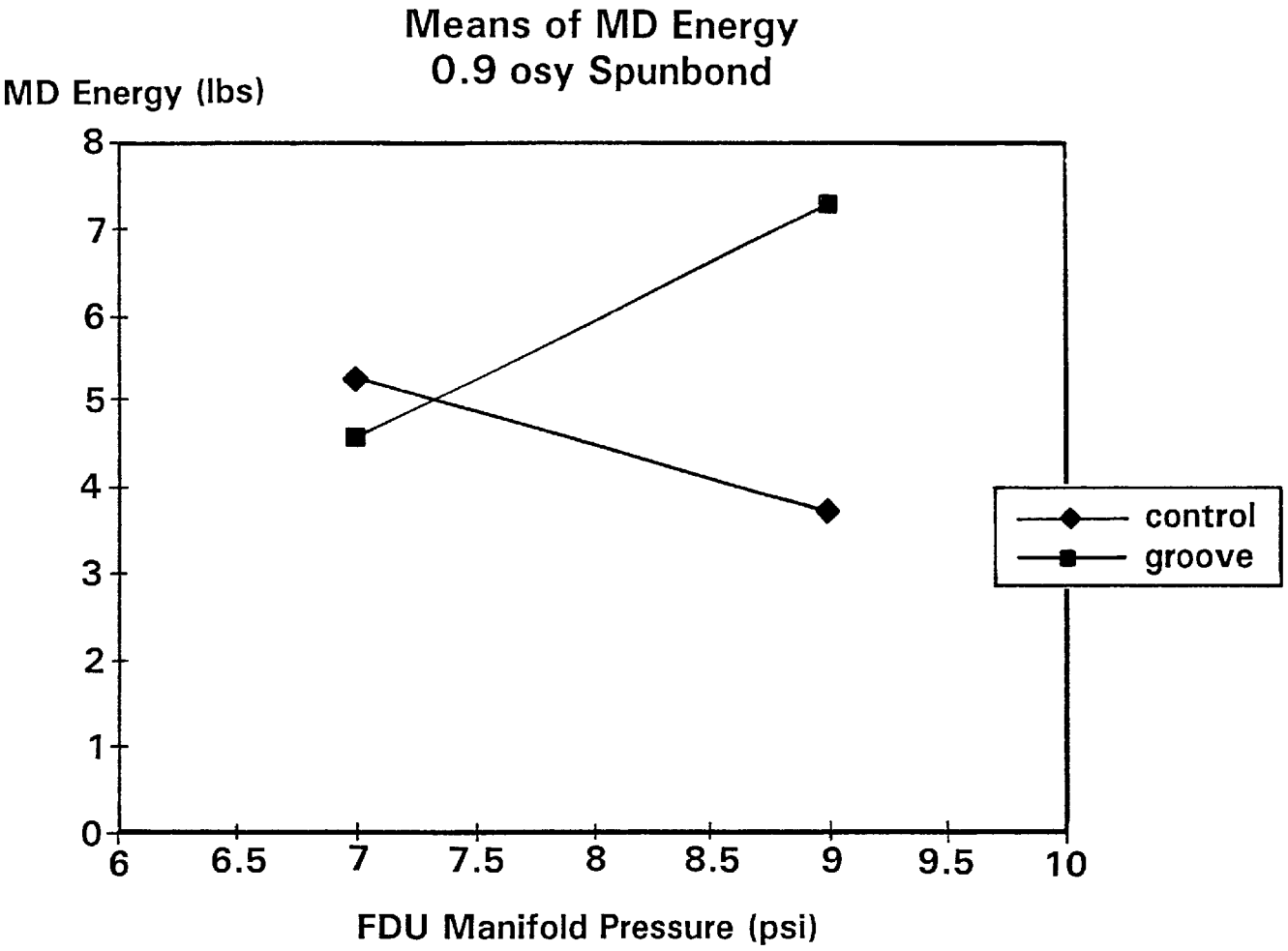

FIG. 12 is a graph of MD energy in pounds-force on the y-axis and pressure in the quench area in pounds/square inch (psi) on the x-axis for 0.9 osy basis weight webs. This graph shows that the MD energy using the grooved drawing unit had a significant increase as the drawing unit pressure was increased while the web from the ungrooved drawing unit showed a significant decrease with increasing drawing pressure. This clearly suggests that the web from the grooved drawing unit was more uniform.

Figure 13:
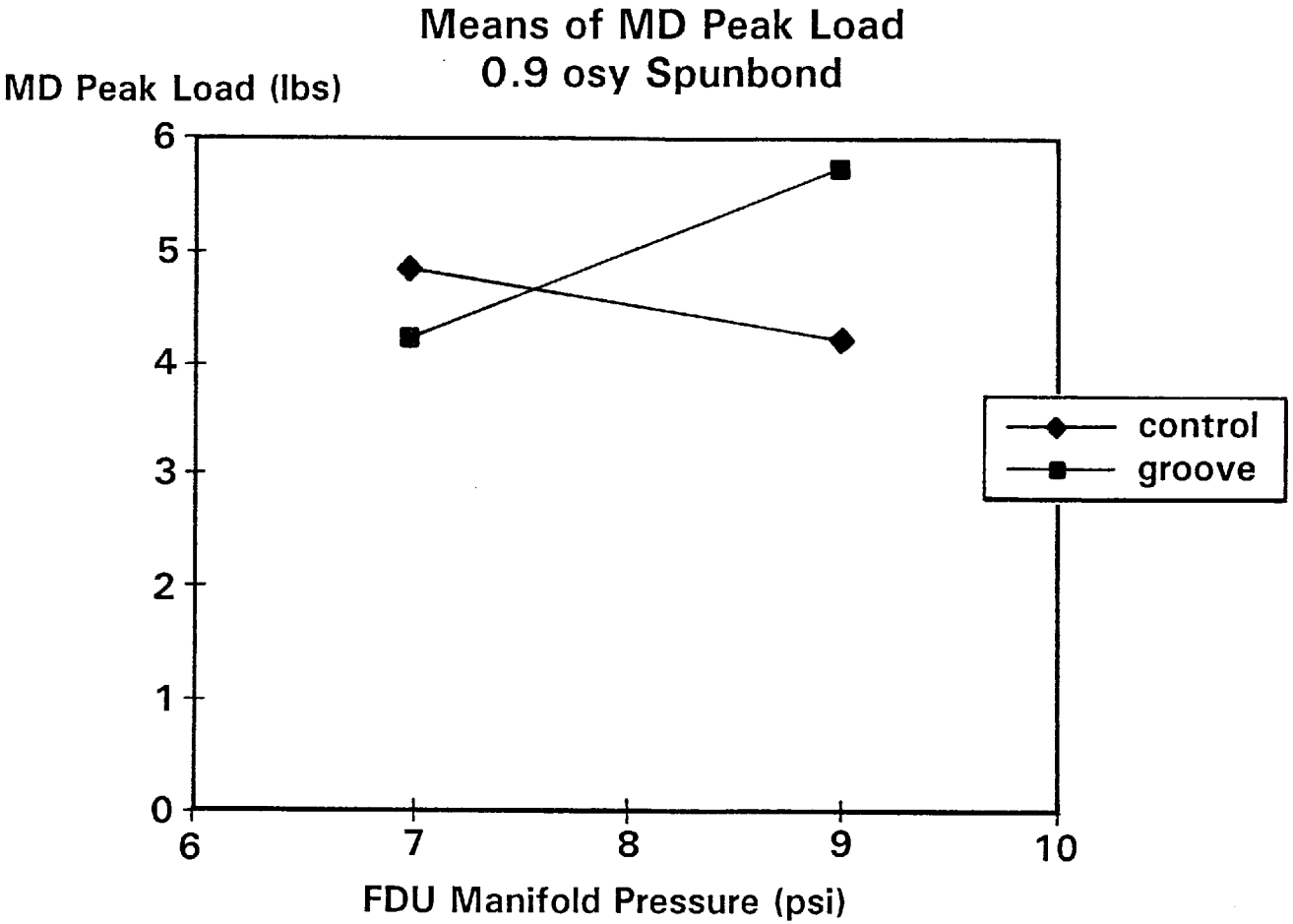

FIG. 13 is a graph of MD peak load in pounds-force on the y-axis and pressure in the quench area in pounds/square inch (psi) on the x-axis for 0.9 osy basis weight webs. This graph shows that the MD peak load using the grooved drawing unit had a significant increase as the drawing unit pressure was increased, while the web from the ungrooved drawing unit showed a significant decrease with increasing draw pressure, similar to FIG. 12.

Figure 14:
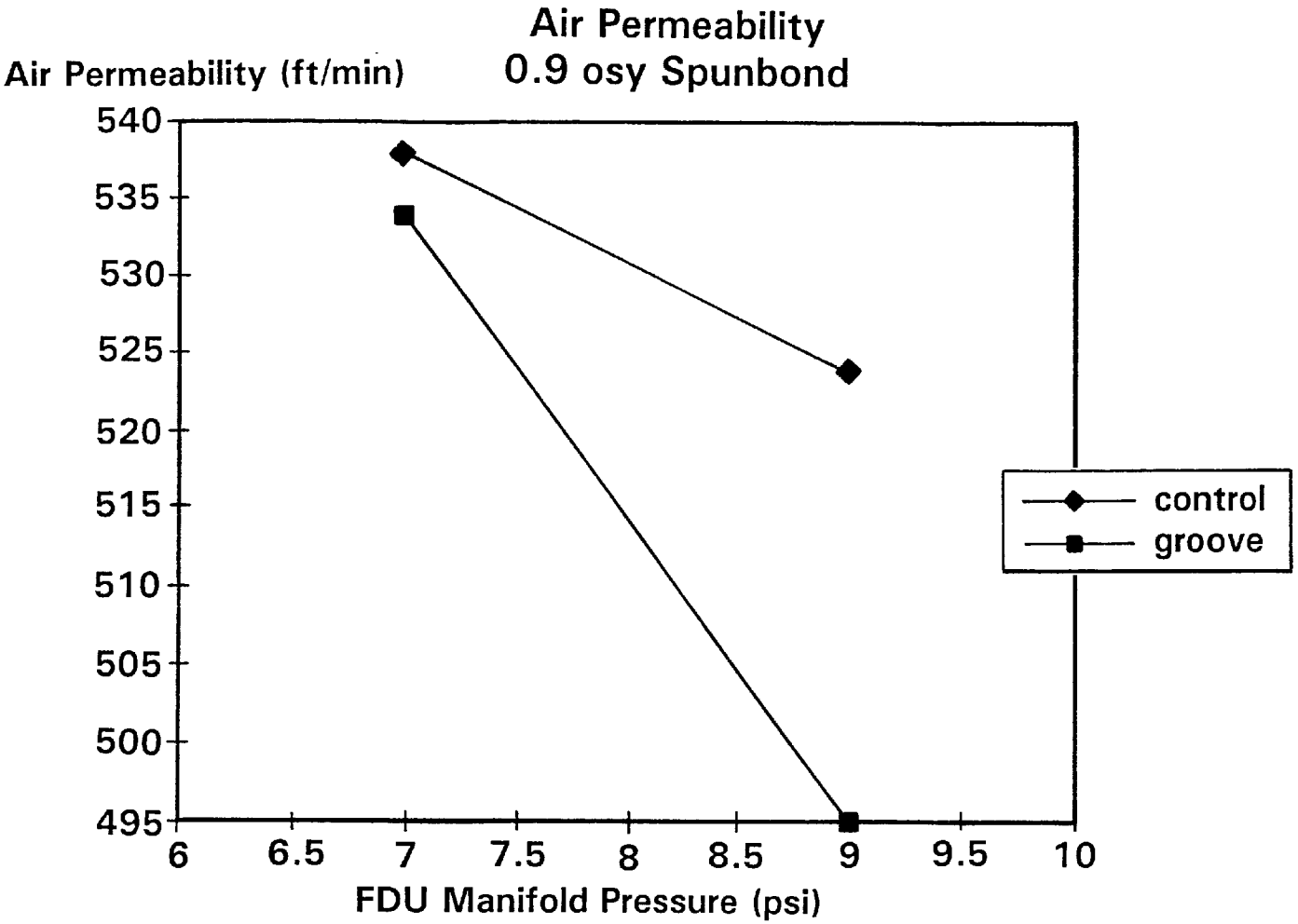

FIG. 14 is a graph of the air permeability of each 0.9 osy web and showed a significant decrease with increasing pressure though the divergence at greater pressure suggests that the web from the ungrooved drawing unit was significantly less uniform.

Figure 15:
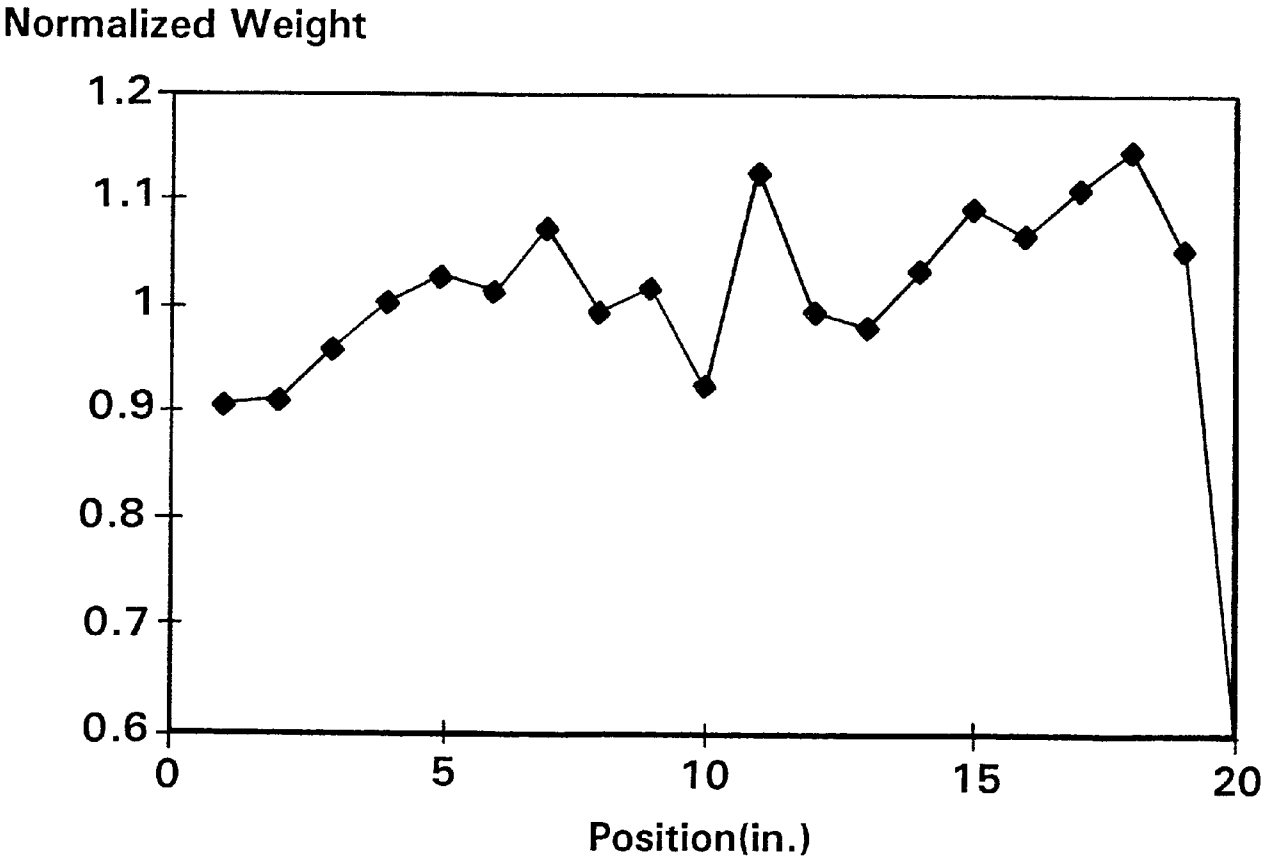
FIGS. 15 and 16 are graphs of the basis weight versus location in 20 inch (51 cm) wide 0.5 osy (17 gsm) meltblown webs. The web of FIG. 15 was produced using an ungrooved pneumatic chamber and FIG. 16 was produced using a grooved pneumatic chamber.

FIG. 15 is a graph of the basis weight versus location in a 20 inch (51 cm) wide, 0.5 osy (17 gsm) meltblown web made from Montell Chemical's PF-015 polypropylene. The data in this graph has been normalized. The pneumatic chamber was ungrooved.

Figure 16:
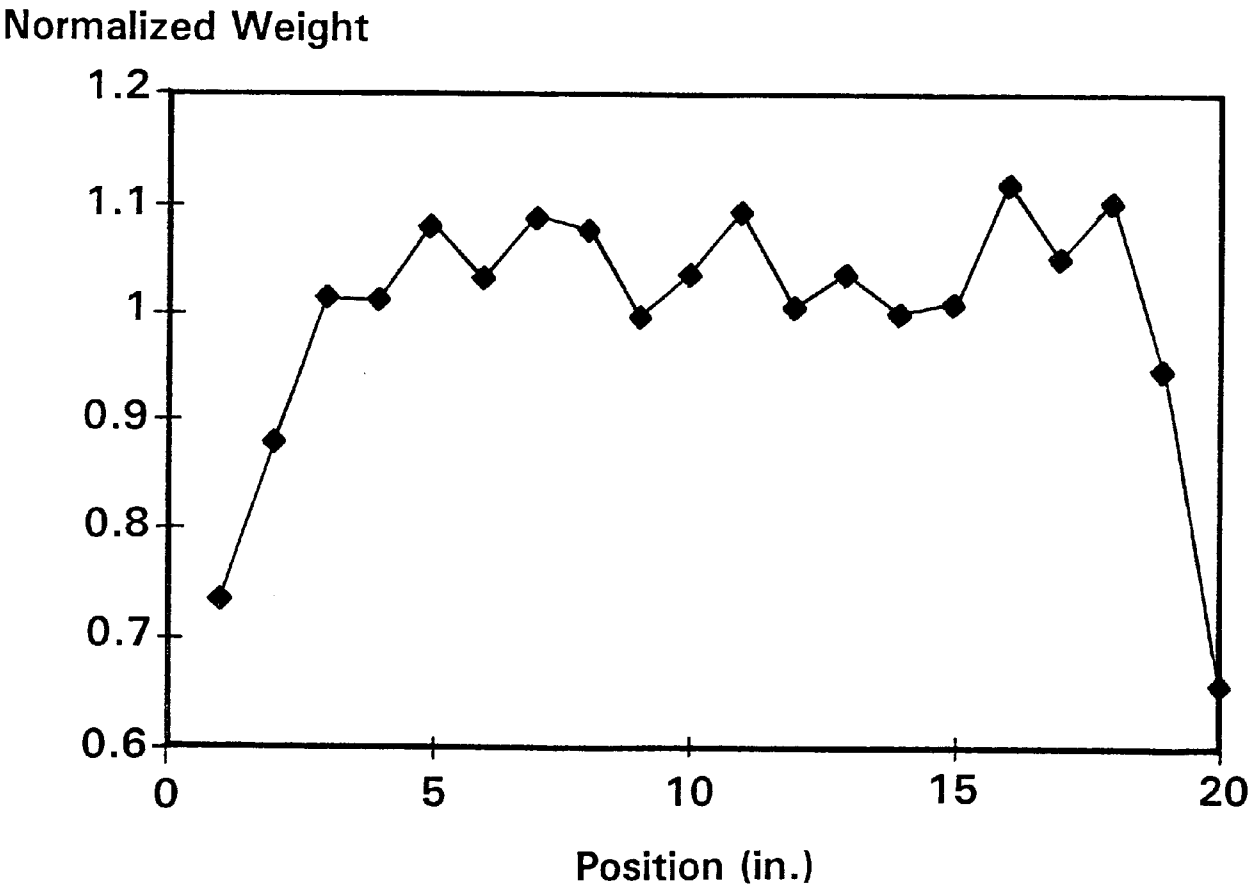

FIG. 16 is a graph of the basis weight versus location in a 20 inch wide, 0.5 osy meltblown web made from Montell Chemical's PF-015 polypropylene. The data in this graph has been normalized. The pneumatic chamber was grooved. The basis weight of this web has a standard deviation of about 10 percent less than the basis weight standard deviation of the web produced using the ungrooved pneumatic chamber.

While the inventors have used grooves of the size indicated in the examples, any groove size, shape, distribution and coverage which resulted in a more uniform web is intended to be within the scope of this invention. The inventors believe that for the best performance, the grooves should cover as much of the pneumatic chamber's inner surface as possible. The grooves should be between 10 and 6500 microns in depth, 10 and 6500 in width, and separated by from 10 to 6500 microns and at least 10 microns. It should also be noted that the configuration of the grooves may be a "V", a rounded "U" or a squared "U" or any other known groove shape. Any effective groove shape is contemplated to be within the definition of the invention.

The grooves may be applied to the pneumatic chamber by scratching, cutting or etching them directly onto the inner surface or by applying a tape or appliqué having the grooves already cut into it and adhering it to the pneumatic chamber with glue. Any effective method would be acceptable so long as an effective amount of the pneumatic chamber's surface contacting the drawing fluid were covered and the web uniformity is improved. In order to be of commercial value, the inventors believe that the improvement in web uniformity should be at least about 10 percent as measured by the tests given herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means plus function claims are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

It should further be noted that any patents, applications or publications referred to herein are incorporated by reference in their entirety.

What is claimed is:

1. A pneumatic chamber for nonwoven fibers comprising a drawing unit having walls between which fibers are conveyed in a fluid flow, wherein said walls have grooves between about 10 and 6500 microns in depth, 10 and 6500 microns in width, are separated by from 10 to 6500 microns and are at an angle to said fluid flow of from 0 degrees to plus or minus 60 degrees.

* * * * *